US007044560B1

(12) United States Patent
Miller et al.

(10) Patent No.: US 7,044,560 B1
(45) Date of Patent: May 16, 2006

(54) NON-ABRASIVE SCRUB PAD WITH MESH NETTING AND METHOD OF MAKING SAID SCRUB PAD

(76) Inventors: Julie L. Miller, P.O. Box 835, Stratford, OK (US) 74872; James Miller, P.O. Box 835, Stratford, OK (US) 74872

( * ) Notice: Subject to any disclaimer, the term of this patent is extended or adjusted under 35 U.S.C. 154(b) by 483 days.

(21) Appl. No.: 10/266,971

(22) Filed: Oct. 8, 2002

(51) Int. Cl.
*A46D 3/00* (2006.01)

(52) U.S. Cl. ..... 300/21; 300/1; 15/209.1; 15/211; 15/225; 15/229.11

(58) Field of Classification Search ..... 15/210.1, 15/209.1, 211, 218, 225, 208, 229.11, 229.12, 15/229.114; 300/1, 21
See application file for complete search history.

(56) References Cited

U.S. PATENT DOCUMENTS 3,066,347 A 12/1962 Vosbikian et al.
3,581,447 A 6/1971 Falivene
4,206,948 A * 6/1980 Shimizu ..... 300/21
4,462,135 A * 7/1984 Sanford ..... 15/105
4,510,641 A 4/1985 Morris
4,665,580 A 5/1987 Morris
4,780,361 A 10/1988 Schlein
6,017,351 A 1/2000 Street
6,251,808 B1 6/2001 Rose et al.
6,290,707 B1 9/2001 Street

* cited by examiner

*Primary Examiner*—Richard Crispino
*Assistant Examiner*—Abraham Bahta
(74) *Attorney, Agent, or Firm*—John D. Gugliotta

(57) ABSTRACT

A non-abrasive scrubbing pad is a scrubbing pad used for cleaning projects. The net scrubbing pad is made from tulle netting fabric, which is fine in nature and virtually incapable of causing damage. The non-abrasive scrubbing pad is sewn together using thread in a chain-stitch pattern, which is extremely durable and long lasting. The non-abrasive scrubbing pad is available in one-ply designs, which would be used for light-duty cleaning tasks, and a two-ply design, which would be used for tougher cleaning jobs. It is envisioned that the non-abrasive scrubbing pad would be available in multiple sizes for all types of cleaning jobs, such as kitchen cleaning, floor cleaning, automobile cleaning ad the like. The use of the non-abrasive scrubbing pad provides users the ability to safely and quickly clean all types of fine finished surfaces without the danger of scratching or damage.

4 Claims, 6 Drawing Sheets

NON-ABRASIVE SCRUB PAD WITH MESH NETTING AND METHOD OF MAKING SAID SCRUB PAD

RELATED APPLICATIONS

The present invention was first described in Disclosure Document Registration 511,616 filed on May 24, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to scrubbing pads, and specifically a scrubbing pad with mesh netting for cleaning delicate housewares and the method of manufacturing said scrubbing pad.

2. Description of the Related Art

One chore that must be performed around almost every home is that of cleaning dishes. Even in homes with the luxury of a dishwasher, one must occasionally immerse dishes in the sink to ensure they are clean or to remove baked or burnt on food before cleaning. This procedure usually requires the use of a scrubbing pad made from a tough synthetic compound or even steel wool. While they usually get the dishes clean, they often leave permanent scratches behind. This is unacceptable on items such as fine crystal, china or glassware. This problem is often evident when cleaning automobiles, at restaurants, the workplace or anywhere fine finished surfaces must be cleaned but not damaged.

A search of the prior art did not disclose any patents that read directly on the claims of the instant invention; however, the following references were considered related:

U.S. Pat. No. 6,290,707 issued in the name of Street, describes a cosmetic abrasive pad and method for scrubbing the epidermis;

U.S. Pat. No. 6,251,808 issued in the name of Rose et al., describes a metal and fiberglass cleaning and polishing article;

U.S. Pat. No. 6,017,351 issued in the name of Street, describes a cosmetic abrasive pad and method for scrubbing the epidermis;

U.S. Pat. No. 4,780,361 issued in the name of Schlein, describes a laminated scrub pad having an abrasive surface;

U.S. Pat. No. 4,665,580 issued in the name of Morris, describes scrubbing pad with an abrasive surface and hand pocket;

U.S. Pat. No. 4,510,641 issued in the name of Morris, describes scrubbing pad with an abrasive surface and hand pocket;

U.S. Pat. No. 3,581,447 issued in the name of Fallvene, describes scrubbing pad with an abrasive surface and hand pocket; and U.S. Pat. No. 3,066,347 issued in the name of Vosbikian, describes scrubbing pad with an abrasive surface and hand pocket.

The cosmetic scrubbing pads disclosed in U.S. Pat. No. 6,290,707 and U.S. Pat. No. 6,017,351, both issued in the name of Street, each describe an abrasive cosmetic pad for removing surface detritus and other debris from a person's skin. The cosmetic scrubbing pad has an abrasiveness sufficient to scrape and/or scratch the skin so as to cause the flaking of excess skin and/or debris.

The scrubbing pad disclosed in U.S. Pat. No. 4,780,361 issued in the name of Schlein describes a laminated scrub pad having an abrasive surface particularly directed to medical uses, such as for scrubbing and cleaning in-ground dirt, grime or blood from the body of a doctor, nurse or patient.

The abrasive scrubbing pads disclosed in U.S. Pat. No. 4,665,580 and U.S. Pat. No. 4,510,641, both issued in the name of Morris, and U.S. Pat. No. 3,581,447 issued in the name of Fallvene, describe elongated scrubbing pads having a highly abrasive surface, such as steel wool. The abrasive scrubbing pad is directed for use as a scouring device for removing leftover or overly cooked food from pots and pans. The scrubbing pads also allows for the insertion of soap or other cleaning detergents. Likewise, U.S. Pat. No. 3,066,347 issued in the name of Vosbikian, describes a plurality of cleaning devices requiring the insertion of soap cakes or other detergent forms for use. The Fallvene further allows a user of wearing the device like an oven mitt.

The present non-abrasive scrubbing pad, as opposed to abrasive scouring pads, is directed for use in cleaning housewares manufactured from crystal, such as stem ware or place settings, glass and fine china, as well as everyday items like plates, silverware and ornamental items. The non-abrasive scrubbing pad also is adaptable for use in cleaning windows, appliances, fiberglass (as found in automobiles), and other surfaces. The non-abrasive scrubbing pad allows for the cleaning of the aforementioned items or surfaces without the worry of scratching and marring those high quality items. The prior art discussed above describes pads that are designed to scratch the desired surfaces to effectively clean those surfaces. With the non-abrasive scrubbing pad, the naturally porous nature of the netting used allows for the collection of soap, water or other liquid detergents into the scrubbing pad without the necessity of having to insert the soap, water or other detergents.

Consequently, there exists a continuous need for new product ideas and enhancements for existing products in the scrubbing pad industry.

SUMMARY OF THE INVENTION

It is therefore an object of the present invention to provide an improved scrubbing pad.

It is a feature of the present invention to provide an improved scrubbing pad having a non-abrasive surface to prevent scratching delicate surfaces.

It is a further feature of the present invention to provide an improved scrubbing pad having a variety of sizes, shapes and colors.

It is still a further feature of the present invention to provide an improved scrubbing pad constructed from inexpensive materials such that the scrubbing pad is inexpensive to manufacture and buy.

It is still a further feature of the present invention to provide an improved scrubbing pad that is easily cleaned.

It is still a further feature of the present invention to provide an improved scrubbing pad that is disposable.

Briefly described according to one embodiment of the present invention, a the net scrubbing pad is a scrubbing pad used for cleaning projects. The invention is made from tulle netting fabric, which is fine in nature and virtually incapable of causing damage. It is sewn together using thread in a chain-stitch pattern, which is extremely durable and long lasting. The invention is available in one-ply designs, which would be used for light-duty cleaning tasks, and a two-ply design, which would be used for tougher cleaning jobs. It is envisioned that the invention would be available in multiple sizes for all types of cleaning jobs, such as kitchen cleaning, floor cleaning, automobile cleaning ad the like. The use of the net scrubbing pad provides users the ability to safely and quickly clean all types of fine finished surfaces without the danger of scratching or damage.

An advantage of the present invention is that it is specifically adapted for use in or outside the home.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
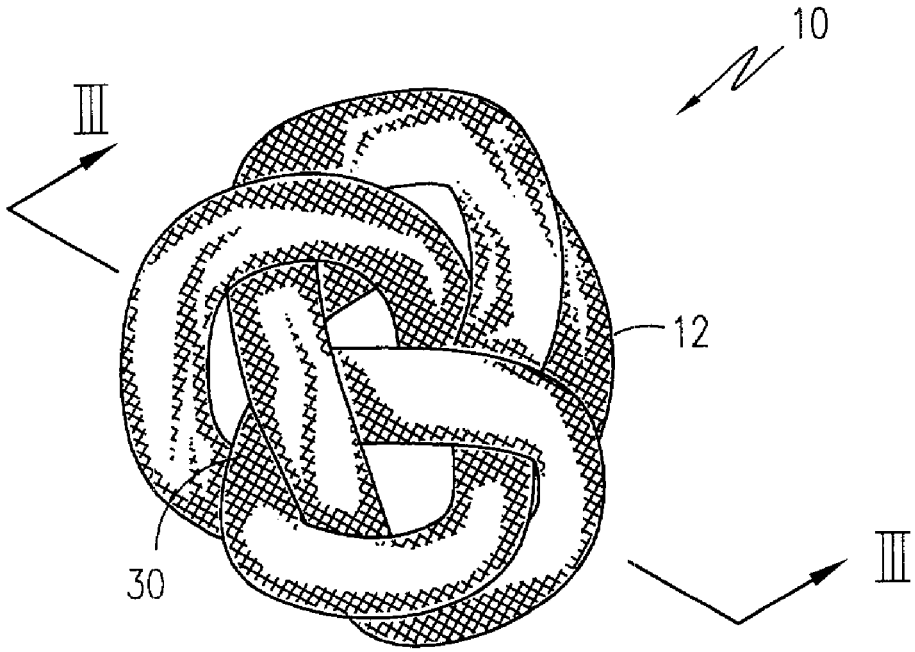
FIG. 1 is an elevated top view of a non-abrasive scrubbing pad.
Figure 2:
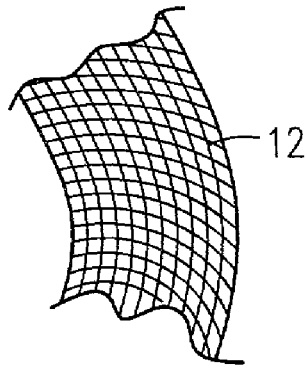
FIG. 2 is an enlarged view of the netting pattern used in the non-abrasive scrubbing pad.
Figure 3:
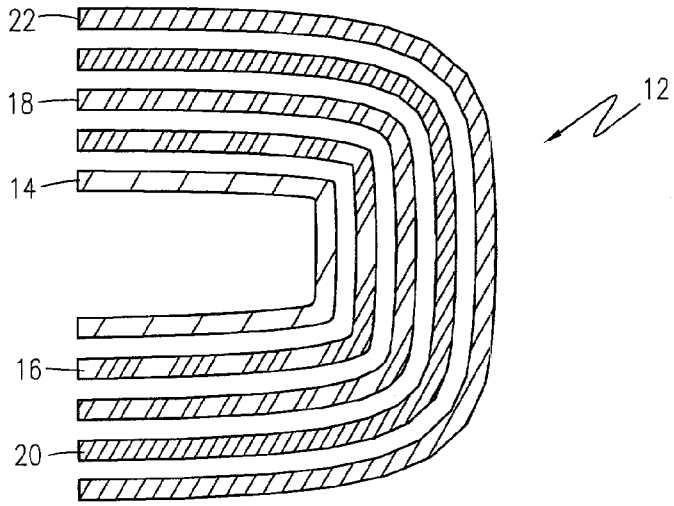
FIG. 3 is a cross sectional view of the apparatus of FIG. 1 taken through the line III—III.
Figure 4:
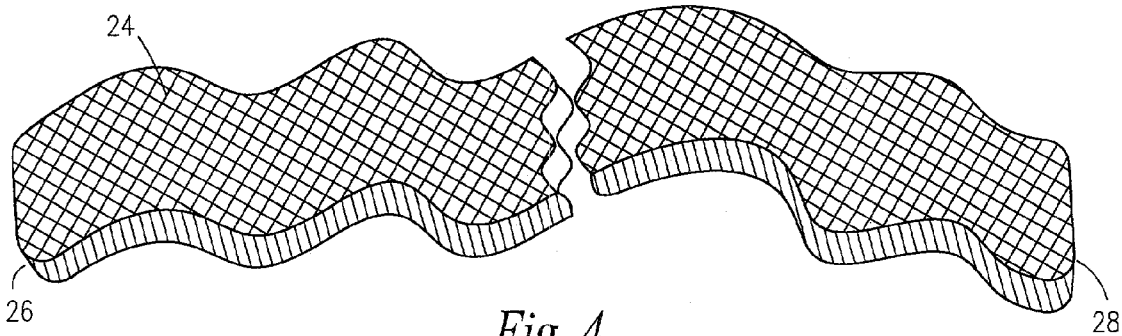
FIG. 4 is a perspective view of a linearly elongated netting strand, which is then tied in loose knots about itself to form the knotted non-abrasive scrubbing pad of FIG. 1.

Referring now to FIG. 1 through FIG. 4, a scrubbing pad 10, in accordance with the preferred embodiment of the present invention, is shown having a plurality of netting strands 12 formed by at least a first strand 14, a second strand 16, and a third strand 18. A fourth strand 20 and a fifth strand 22 are shown in FIG. 2 to illustrate the multi-layered arrangement that the netting strands 12 may assume. The plurality of netting strands 12 form a linearly elongated netting strand 24 having a first end 26 and a second end 28, in which the second end 28 is opposite to the first end 26.

Figure 5:
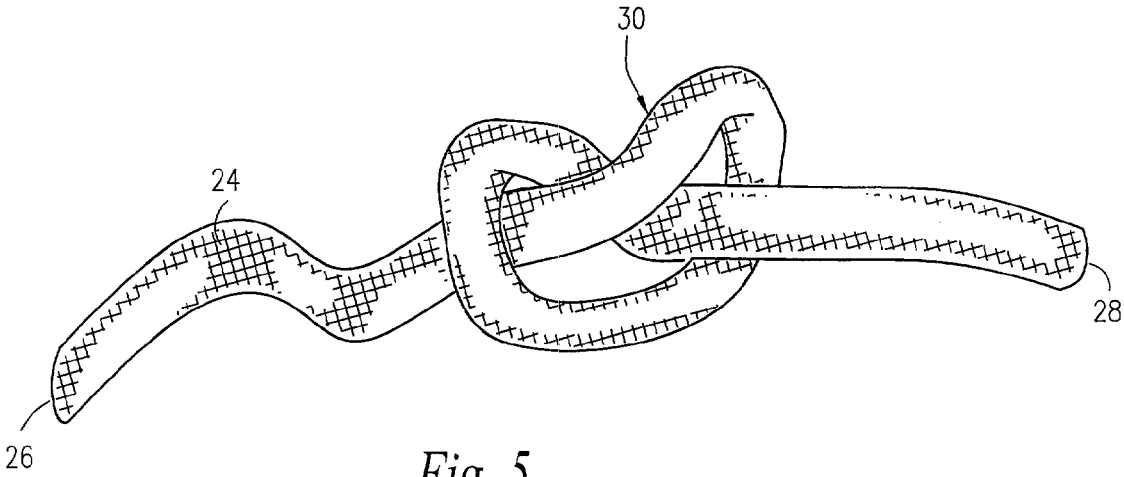
FIG. 5 is a perspective view of the apparatus of FIG. 4, wherein the apparatus is tied in a single loose knot to illustrate one part of the method for creating the non-abrasive scrubbing pad of FIG. 1.

Referring now to FIG. 5, the linearly elongated netting strand 24 is gently and loosely tied around itself, forming a plurality of knots 30, although other shapes or forms are envisioned by manipulating or tying the netting strand 24 in different ways. The process continues until the entire netting strand 24 is completely knotted about itself. After a sufficient number of knots 30 are created, the first end 26 is tied to the second end 28 to form an enclosed device to which the first end 26 and the second end 28 are indistinguishable. This arrangement results in an item that may be held by hand with no distinguishable beginning or ending point, forming a substantially enclosed surface area sufficient for scrubbing and cleaning a desired item.

Figure 6:
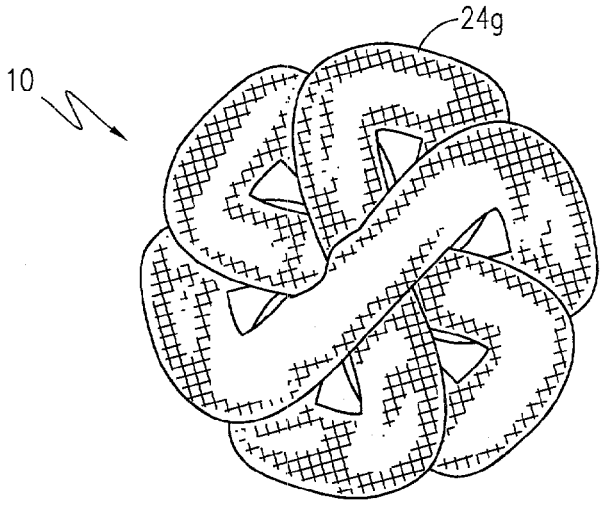
FIG. 6 is a top view of an alternative embodiment of the non-abrasive scrubbing pad, shown here as a flower-shaped pad.
Figure 7A:
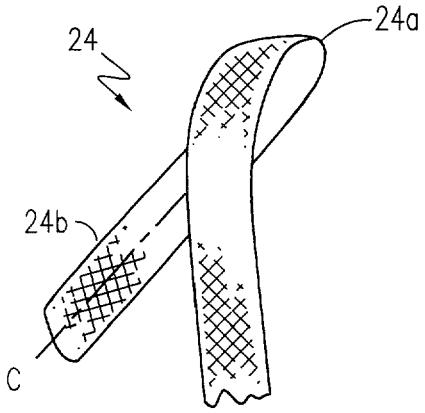
FIG. 7A is a perspective view of a netting strand being tied in a bow shape so as to begin the process of forming a flower shaped non-abrasive scrubbing pad.
Figure 7B:
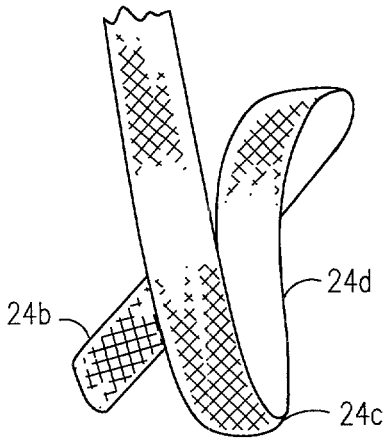
FIG. 7B is a perspective view of the netting strand being tied into a second bow shape, continuing the process of forming a flower shaped non-abrasive scrubbing pad.
Figure 7C:
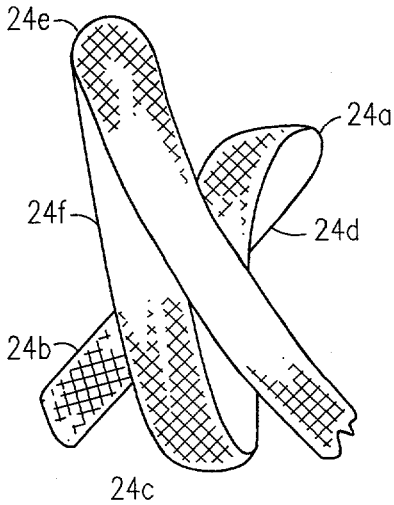
FIG. 7C is a final perspective view of the netting strand being tied into a third bow shape.

Referring now to FIG. 6 and FIGS. 7A–FIG. 7C, a first alternative embodiment of the non-abrasive scrubbing pad 10 is shown. FIG. 6 shows a flower shaped alternative embodiment, in which the netting strand 24 is placed over itself in a repeating fashion. FIGS. 7A–7C show the repeated process, in which an approximately three inch first section of the netting strand 24 is doubled-over at an end 24*a*, and the remaining strand 24 is directed slightly off-center (center is noted a the phantom line "C") from the underlying strand section 24*b*. An approximate three inch second section is again doubled-over at an end 24*c*, and the remaining strand 24 is directed slightly off-center from the underlying strand section 24*d*, but crossing the approximate center point of the first strand section 24*b*. Again, an approximate three inch third section is doubled-over at an end 24*e*, and the remaining strand 24 is directed slightly off-center from the underlying strand section 24*f*, but crossing the approximate center point of the second strand section 24*d*. This process is repeated until the entire netting strand 24 is used and the resulting pad is shaped in the form of a flower. The last remaining remnant of the netting strand 24 is tied about the center of the pad 24*g* to secure the non-abrasive scrubbing pad 10 and prevent the flowered arrangement from unwinding.

Figure 8:
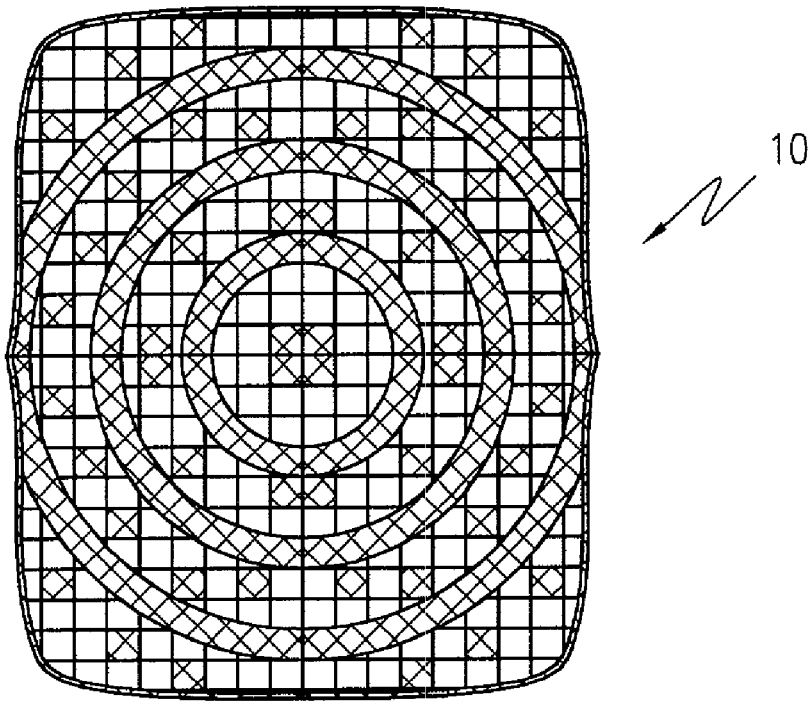
FIG. 8 is a top view of another alternative embodiment of the non-abrasive scrubbing pad, shown here as a flattened pad with the netting formed in a crochet pattern.
Figure 9:
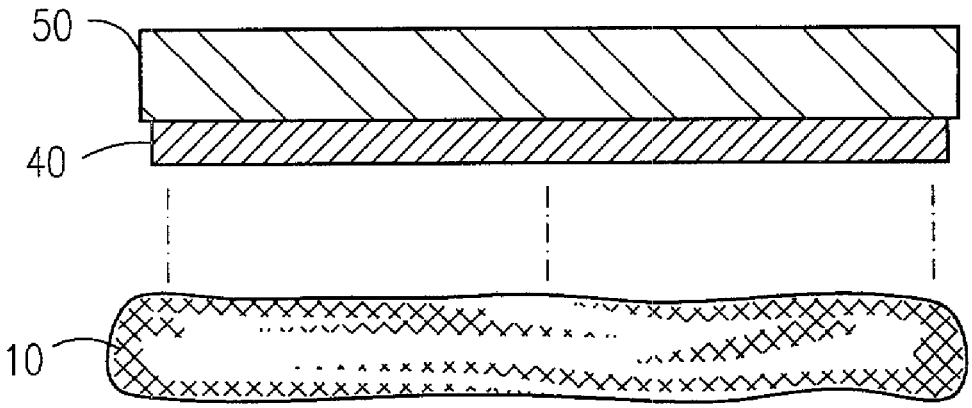
FIG. 9 is a side view of another alternative embodiment of the non-abrasive scrubbing pad, in which the scrubbing pad is attached to a support structure via adhesive.
Figure 10:
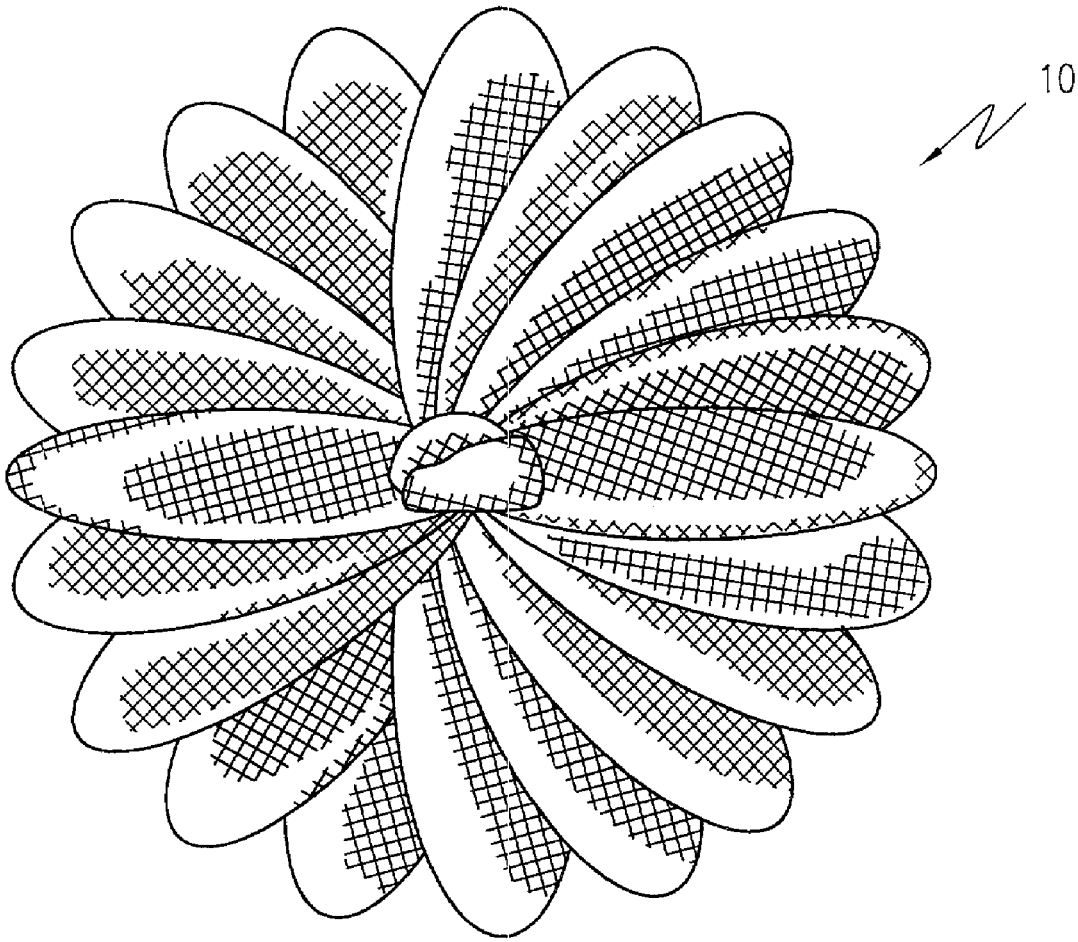
FIG. 10 is a top view of another alternative embodiment of the non-abrasive scrubbing pad, shown here as a folded pad with the netting formed in a flower pattern.

Referring now to FIG. 8, a second alternative embodiment of the non-abrasive scrubbing pad 10 is shown. FIG. 8 shows a crochet-patterned non-abrasive scrubbing pad 10, in which the netting strand 24 is tied about itself in a crocheted pattern known in the art.

An alternative embodiment envisions the scrubbing pad 10 adhesively affixed 40 to a semi-rigid structure 50, such as sponge or other similar object, creating a multi-purpose scrubbing pad that may scrub, rub, and absorb debris or liquid from the cleaned objected.

Preferably, the netting strand 24 is manufactured from a non-scratching material, such as nylon or another similar material, and is formed into a lattice arrangement similar to the lattice of a net, but on a much smaller scale.

2. Operation of the Preferred Embodiment

The method for making the scrubbing pad 10 is to gently and loosely tie the linearly elongated netting strand 24 about itself, forming a plurality of knots 30. The process continues until the entire netting strand 24 is completely knotted about itself. After a sufficient number of knots 30 are created, the first end 26 is tied to the second end 28 to form an enclosed device to which the first end 26 and the second end 28 are indistinguishable. This arrangement results in an item that may be held by hand with no distinguishable beginning or ending point, forming a substantially enclosed surface area sufficient for scrubbing and cleaning a desired item.

To use the scrubbing pad 10 a user will place the scrubbing pad 10 into soapy water or other suitable cleaning solution, absorbing said solution and then using a hand to work the pad in a circular or linear motion to clean the desired item. After the scrubbing is finished, the scrubbing pad 10 is rinsed in clean water and left to dry for the next use. The aforementioned scrubbing will result in a clean, yet unmarred, finish.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A method of making a scrubbing pad comprising of the steps of:

a. looping a linearly elongated netting strand about said netting strand;

b. gently forming a knot; and c. repeating said looping of said netting strand and forming of knot until a first end of said netting strand is tied to a second end of said netting strand to form an enclosed scrubbing pad.

2. A scrubbing pad made by the method of claim 1, wherein said scrubbing pad comprising a plurality of netting strands formed by at least a first strand, a second strand, and a third strand, thereby forming a linearly elongated netting strand, said netting strand having a first end and a second end.

3. The scrubbing pad of claim 2 further comprising a fourth strand and a fifth strand.

4. A method of making a scrubbing pad comprising of the steps of:

a. folding an approximately three inch first section of netting strand;

b. directing the remaining unfolded netting strand approximately off-center from said underlying section of netting strand;

c. folding a second section of netting strand, wherein said second section of netting strand crosses approximately over a center point of said first strand section;

d. folding a third section of netting strand, wherein said third section of netting strand crosses approximately over a center point of said second strand section;

e. repeating folding of successive netting strand sections until length of said netting strand is exhausted; and f. tying each end of said netting strand about a center of said scrubbing pad so as to prevent unraveling of said scrubbing pad.

* * * * *